US007764182B2

(12) United States Patent
Chian et al.

(10) Patent No.: US 7,764,182 B2
(45) Date of Patent: Jul. 27, 2010

(54) FLAME SENSING SYSTEM

(75) Inventors: Brent Chian, Plymouth, MN (US); Peter M. Anderson, Minneapolis, MN (US); Timothy J. Nordberg, Plymouth, MN (US); Bruce Hill, Roseville, MN (US)

(73) Assignee: Honeywell International Inc., Morristown, NJ (US)

( * ) Notice: Subject to any disclaimer, the term of this patent is extended or adjusted under 35 U.S.C. 154(b) by 1476 days.

(21) Appl. No.: 10/908,466

(22) Filed: May 12, 2005

(65) Prior Publication Data

US 2006/0257802 A1 Nov. 16, 2006

(51) Int. Cl.

| | |
|---|---|
| ***G08B 17/12*** | (2006.01) |
| ***G08B 19/02*** | (2006.01) |
| ***G08B 17/00*** | (2006.01) |
| ***G08B 17/06*** | (2006.01) |

(52) U.S. Cl. ..... 340/577; 340/578; 340/581; 340/584; 340/593; 340/600

(58) Field of Classification Search ..... 340/577
See application file for complete search history.

(56) References Cited

U.S. PATENT DOCUMENTS

| | | | | |
|---|---|---|---|---|
| 3,909,816 | A | 9/1975 | Teeters | |
| 4,157,506 | A | 6/1979 | Spencer | |
| 4,221,557 | A | 9/1980 | Jalics | |
| 4,280,184 | A * | 7/1981 | Weiner et al. | 340/578 |
| 4,483,672 | A | 11/1984 | Wallace et al. | |
| 4,655,705 | A | 4/1987 | Shute et al. | |
| 4,672,324 | A * | 6/1987 | van Kampen | 307/653 |
| 4,695,246 | A | 9/1987 | Beilfuss et al. | |
| 4,830,601 | A | 5/1989 | Dahlander et al. | |
| 4,842,510 | A | 6/1989 | Grunden et al. | |
| 4,872,828 | A | 10/1989 | Mierzwinski | |
| 4,955,806 | A | 9/1990 | Grunden et al. | |
| 5,037,291 | A | 8/1991 | Clark | |

(Continued)

FOREIGN PATENT DOCUMENTS

| | | |
|---|---|---|
| EP | 0967440 | 12/1999 |

(Continued)

OTHER PUBLICATIONS

Honeywell, "S4965 SERIES Combined Valve and Boiler Control Systems," 16 pages, prior to the filing date of present application.

(Continued)

*Primary Examiner*—Daniel Wu
*Assistant Examiner*—Pameshanand Mahase
(74) *Attorney, Agent, or Firm*—Crompton Seager & Tufte LLC

(57) ABSTRACT

A low cost flame sensing system having at last one floating point. For instance, the system may have two grounds. There may be a flame sensing rod for detecting a flame which has a model circuit which appears upon the existence of the flame proximate to the sensing rod. The sensing rod may function without an explicit or dedicated excitation source connected to it. There may be diagnostics in the system for detecting leakage or shorts of the sensing rod to ground. Also, the system may have AC grounding phase detection.

25 Claims, 5 Drawing Sheets

U.S. PATENT DOCUMENTS

| | | | | |
|---|---|---|---|---|
| 5,077,550 | A | 12/1991 | Cormier | |
| 5,112,217 | A | 5/1992 | Ripka et al. | |
| 5,126,721 | A | 6/1992 | Butcher et al. | |
| 5,158,447 | A | 10/1992 | Geary | |
| 5,175,439 | A | 12/1992 | Harer et al. | |
| 5,222,888 | A | 6/1993 | Jones et al. | |
| 5,236,328 | A | 8/1993 | Tate et al. | |
| 5,255,179 | A | 10/1993 | Zekan et al. | |
| 5,280,802 | A | 1/1994 | Comuzie, Jr. | |
| 5,347,982 | A | 9/1994 | Binzer et al. | |
| 5,391,074 | A | 2/1995 | Meeker | |
| 5,424,554 | A | 6/1995 | Marran et al. | |
| 5,472,336 | A * | 12/1995 | Adams et al. | 431/6 |
| 5,506,569 | A * | 4/1996 | Rowlette | 340/577 |
| 5,567,143 | A | 10/1996 | Servidio | |
| 5,797,358 | A | 8/1998 | Brandt et al. | |
| 5,971,745 | A | 10/1999 | Bassett et al. | |
| 6,060,719 | A | 5/2000 | DiTucci et al. | |
| 6,084,518 | A | 7/2000 | Jamieson | |
| 6,222,719 | B1 | 4/2001 | Kadah | |
| 6,261,086 | B1 * | 7/2001 | Fu | 431/79 |
| 6,299,433 | B1 | 10/2001 | Gauba et al. | |
| 6,346,712 | B1 * | 2/2002 | Popovic et al. | 250/554 |
| 6,486,486 | B1 * | 11/2002 | Haupenthal | 250/554 |
| 6,509,838 | B1 | 1/2003 | Payne et al. | |
| 6,676,404 | B2 * | 1/2004 | Lochschmied | 431/75 |
| 6,743,010 | B2 | 6/2004 | Bridgeman et al. | |
| 6,794,771 | B2 | 9/2004 | Orloff | |
| 2002/0099474 | A1 | 7/2002 | Khesin | |
| 2003/0064335 | A1 | 4/2003 | Canon | |
| 2004/0209209 | A1 | 10/2004 | Chodacki et al. | |

FOREIGN PATENT DOCUMENTS

| | | |
|---|---|---|
| EP | 1148298 | 10/2001 |
| WO | 9718417 | 5/1997 |

OTHER PUBLICATIONS

Honeywell, "SV9410/SV9420; SV9510/SV9520; SV9610/SV9620 SmartValve System Controls," Installation Instructions, 16 pages, 2003.

www.playhookey.com, "Series LC Circuits," 5 pages, printed Jun. 15, 2007.

* cited by examiner

FLAME SENSING SYSTEM

BACKGROUND

The invention pertains to sensors, and particularly to flame sensors. More particularly, the invention pertains to circuitry for flame sensors.

The present application is related to the following indicated patent applications: "Dynamic DC Biasing and Leakage Compensation", U.S. application Ser. No. 10/908,463, filed May 12, 2005; "Leakage Detection and Compensation System", U.S. application Ser. No. 10/908,465, filed May 12, 2005; "Adaptive Spark Ignition and Flame Sensing Signal Generation System", U.S. application Ser. No. 10/908,467, filed May 12, 2005; which are all incorporated herein by reference.

SUMMARY

The invention may include a flame sensor for a control system having at least one floating reference point and diagnostics relating to the system.

DESCRIPTION

Hydrocarbon flames may have certain electrical properties. A commonly used electrical flame model may be a diode in series with a resistor and a leakage resistor in parallel with the diode and resistor combination. Many flame detectors rely on the flame diode behavior. These detectors may have a relatively high voltage AC signal coupled to the flame (detector) through a capacitor. When a flame exists, because of the flame diode effect, a DC offset voltage may appear. Flame detection may be realized by detecting the existence and amplitude of the DC offset component. When the flame is weak, the series resistance (according to the flame model) may be quite large, resulting in the generating of a very small DC component and then making flame detection more difficult. To compensate for the reduced DC component, the device for detecting a weak flame may have to be very sensitive, or the AC excitation voltage may need to be increased up to several hundred volts. If a standard line voltage is used, then filtration of the low-frequency AC component may require high ohm filter resistors that slow a circuit's detection of a flame and add vulnerability to leakage. If a high-frequency voltage AC signal is generated locally to avoid the problems of high ohm resistors, then the cost of the flame sensing system may increase significantly. The present invention may provide a solution to the noted problems by utilizing the leakage resistor of the flame model rather than the diode. Leakage may be used for diagnostic purposes. The phases between certain components and one of the grounds may have a synch or out-of-synch relationship. This relationship may also be used for diagnostic purposes. There may be other leakage detected.

Figure 1:
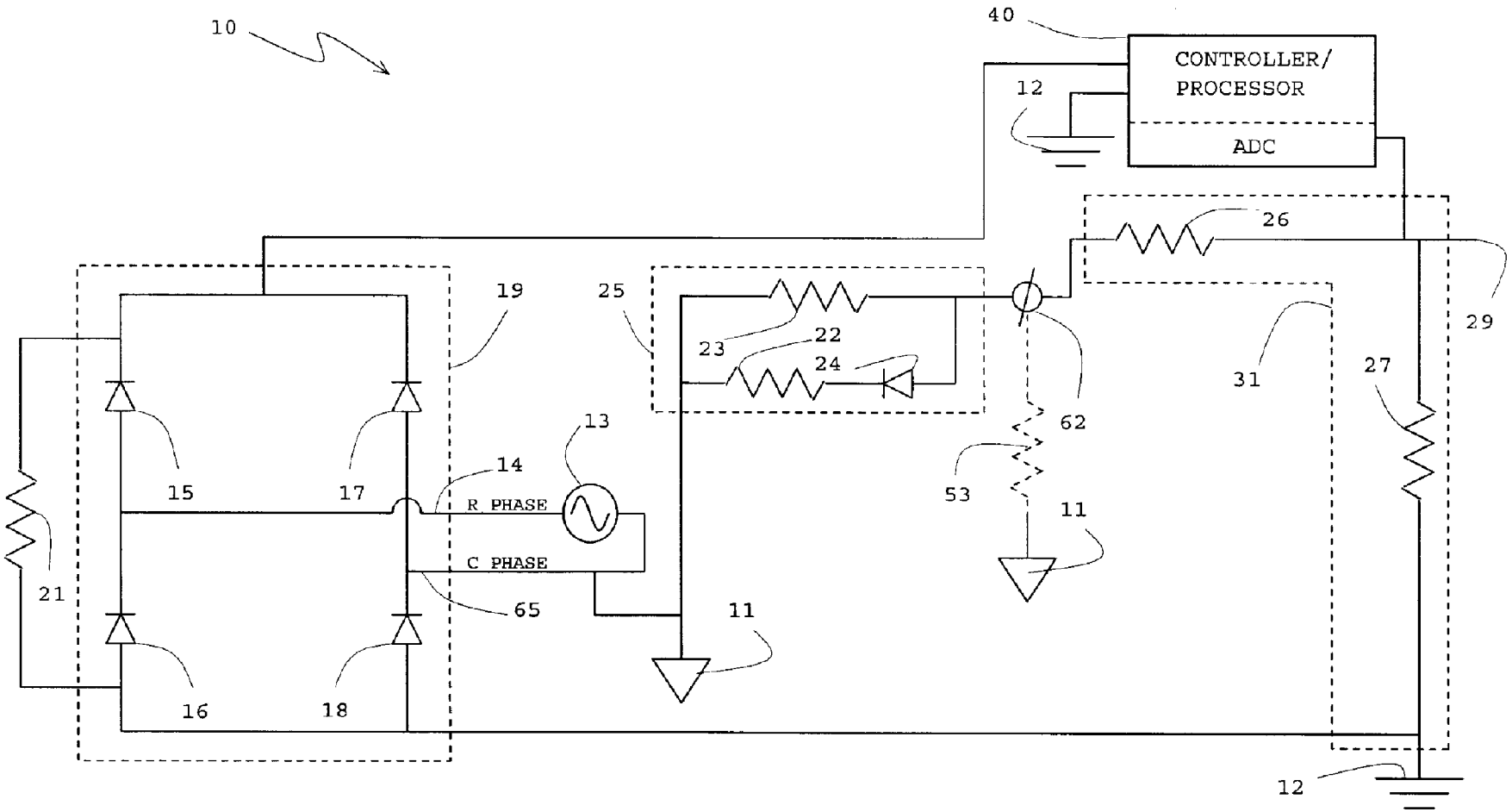
FIG. 1 is a circuit of a flame sensing system.

FIG. 1 reveals a flame sensing system that does not have a flame excitation signal at the flame sensing rod. Instead, the sensing system uses the voltage difference between an earth ground 11 and a control ground 12 to detect the current path provided by the flame. The flame sensing system, without circuit to generate the excitation signal, may be of very low system cost. The system may have a system reference point 12 (i.e., the control ground) floating relative to the earth ground 11. An AC power supply 13 may be common line power or 24 volts AC from a transformer or other power source. One end of the AC power supply 13 may be connected to the earth ground 11 which may also be regarded as an appliance ground. The ground 11 connected to one end of the AC supply 13 may be designated as a C phase. The other end 14 of the supply 13 may be designated as an R phase. The anode of diode 15 and the cathode of diode 16 may be connected to a lead 14 of the AC supply 13. The anode of diode 17 and the cathode of diode 18 may be connected to lead 65 of the supply 13. The cathodes of diodes 15 and 17 may be connected to each other. The lead 65 and ground 11 may be commonly connected. The anodes of diodes 16 and 18 may be connected together and to a circuit or control ground 12. Diodes 15, 16, 17 and 18 may form a full-wave rectifier 19. A load resistor 21 may have one end connected to the cathodes of diodes 15 and 17 and the other end connected to the anodes of diodes 16 and 18. The ends of resistor 21 may look at a full-wave DC output of rectifier 19 which is a rectification of the AC output of supply 13. Resistor 21 may represent a control system load, such as for example, supporting electronics and/or a microcontroller 40.

A first flame resistor 22 may have an end connected to the appliance or earth ground 11. A second flame resistor 23 may have an end connected to the ground 11. A flame diode 24 may have a cathode connected to the other end of resistor 22 and an anode connected to the other end of resistor 23. The flame diode 24, the first flame resistor 22 and the second flame resistor 23 may make up a model circuit or network 25 that indicates a presentation of a flame.

A resistor 26 may have one end connected to a flame rod 62. The other end of resistor 26 may be connected to a terminal 29. One end of a resistor 27 may be connected to the terminal 29 and the other end of the resistor 27 may be connected to the circuit ground 12. Also shown is a dashed-line resistor symbol 53 representing a leakage current path from rod 62 to ground 11. Resistor 26 and resistor 27 may form a flame detection interface circuit 31. Resistors 26 and 27 may form a voltage divider. Resistor 26 may provide current limiting of flame detection signals to an analog-to-digital (A/D) converter input which is connected to the terminal 29. The resistor 27 may help to convert the flame current into a flame voltage. Also, resistor 27 may pull down the A/D input at terminal 29 when there is no signal present to the A/D input. Optionally, a capacitor (not shown) may be connected in parallel with resistor 27 to filter out any induced noise at terminal 29. A flame signal from circuit 25 may go via resistor 26 and node or terminal 29 to the A/D converter of a microcontroller 40.

Figure 2:
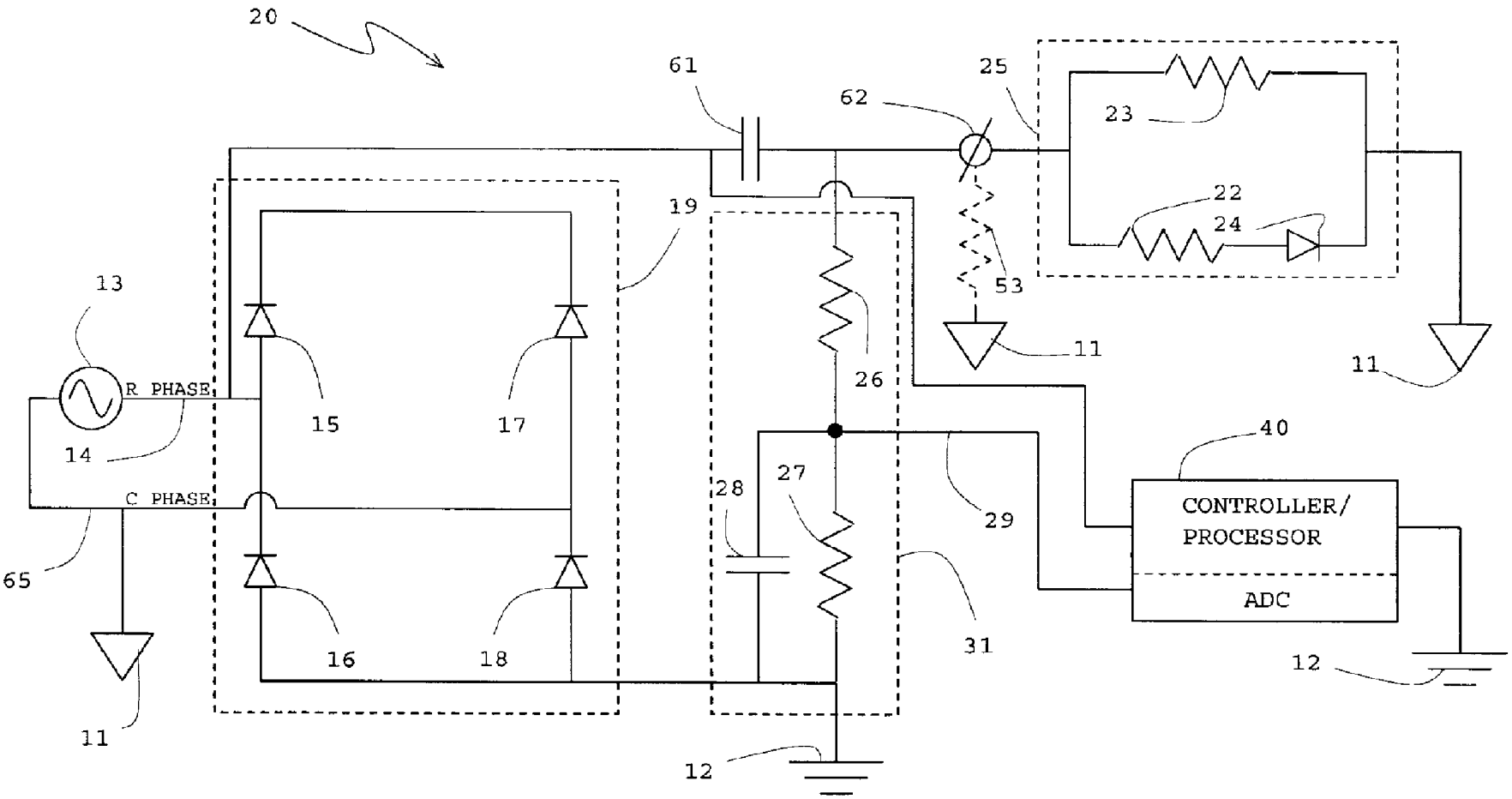
FIG. 2 is another circuit of the flame sensing system.

FIG. 2 shows a circuit configuration 20 which may be partially different than that of circuit 10 in FIG. 1. Source 13 is like that of circuit 10 in that it may be a line voltage of about 115 or 220 volts at 50 or 60 Hz or so. It may instead be 24 volts or some other low voltage. The source 13 may be a secondary winding of a transformer. The source 13 may have one side connected to the appliance ground 11. If an AC voltage that is used is about 100 volts or higher, then a low cost flame sensing approach may be implemented (e.g., a voltage increaser might not be needed). One end of a capacitor 61 may be connected to the R-phase line 14. Capacitor 61 may be a DC blocking capacitor. The other end of capacitor may be connected to resistor 26 of network 31 and to a sensing flame rod 62 which is connected to a representative or model circuit 25 which appears electrically when a flame is sensed. When a flame is not present, the electrical equivalent circuit 25 may appear as open or non-existent concerning diode 24 and resistors 22 and 23. However, current leakage may remain in absence of a sensed flame, as its path may be represented by a resistor symbol 53. The cathode of diode 24 and one end of the resistor 23, when model circuit 25 appears during the sensing of a flame, may be connected to the earth or appliance ground 11. Leakage path 53 likewise may connect flame rod 62 to ground 11.

Resistor 26 may be part of a voltage divider that includes a resistor 27. An optional capacitor 28 (shown) may be connected in parallel with resistor 27. The other end of resistor 27 may be connected to the circuit or control ground 12. An output 29 of the network 31 may go to an A/D converter of a microcontroller or processor 40. The controller or processor may be electrically referenced on or tied to a circuit or control ground 12. The circuit or control ground 12 may float relative to the appliance or earth ground 11.

Resistor 27 and capacitor 28 may be selected such that a time constant of resistor 27 and an optional capacitor 28 equals to about 0.3 to 1.0 portion of a half-cycle of time of the AC power supply 13 output. With this time constant value, the peaks of the flame signal may appear at about the zero-crossing time of the C phase pulses (i.e., <90 degrees out of phase), and the peak-to-peak value of the flame signal may be attenuated very little. One set of exemplary values may include resistor 26 as one megohm, resistor 27 as one megohm, and the optional capacitor as 4700 picofarads.

The leakage of the flame rod 62 may occur due to, for example, old or weak insulation. There may be cross-leakage or other kinds of leakage. The leakage may be measured for calibration purposes. A leakage component may be used to detect a flame rod short, open, or leakage to something such as one of the grounds or components. Leakage may range from the nanoampere to the microampere range. For instance, there may be a one microampere of leakage current and the flame sensor may be usable for flame detection purposes despite a 200 nanoampere signal indicating a flame. Flame indication currents may range from hundreds of nanoamperes to several tens of microamperes. If the leakage current is beyond a level where the system can not be comfortably relied on, the system may be calibrated relative to the leakage (e.g., with a leakage current magnitude subtracted from a flame indication signal).

Figure 3:
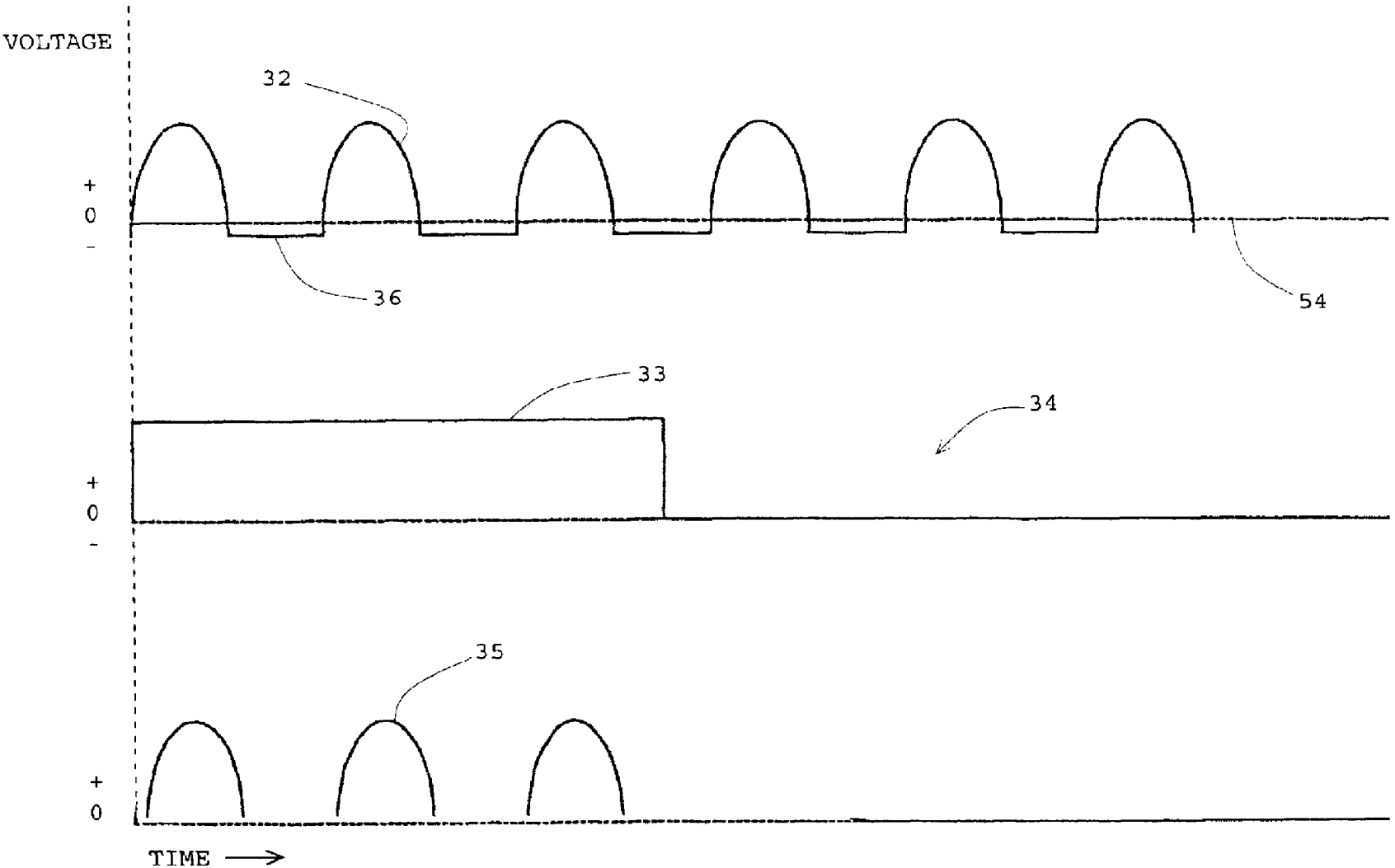
FIG. 3 is a graph of flame sensing signal relative to a ground and flame on and off signals.

FIG. 3 reveals waveforms of the C phase pulses 32, a flame on time 33 and off time 34, and a flame signal 35 at the A/D input terminal 29. The C phase peaks 32 may be about 33 volts for a 24 volt AC powered system and about 162 volts for a 115 volt AC powered system. The floor 36 of the C phase pulses 32 may be about one diode drop below the circuit ground 12 level 54.

There may be several situations involving flame rod sensor leakage: no flame and no leakage; no flame and some leakage; a flame and no leakage; and a flame and some leakage. These combinations may be apparent on the signal at the terminal 29 to the A/D converter of the controller or processor 40. When a flame exists, the flame leakage resistor 23 may provide a current path from the C phase to the interface circuit 31. The resulting current may produce a flame voltage signal at the A/D input 29. The micro controller 40 may note the peak-to-peak value of the flame voltage signal and determine if a flame exists and if so whether the flame is strong enough. When a flame does not exist, the current path may be open and no flame signal is present at the A/D input 29. Consequently, the flame diode 24 and the series flame resistor 22 appear to have little or no effect on the flame leakage detection mechanism. Inherently, the flame circuit 25 appears to be sensitive to current leakage from the earth ground 11 to flame rod 62.

When there is no flame, the circuit 25 is open or at that time non-existent. However, there may be current leakage of the flame rod 62 when there is no flame, which may be represented by a resistance 53 as shown in circuit 20 in FIG. 2. This resistance 53 and resultant leakage may exist even when there is no flame. In FIGS. 1 and 2, rod leakage resistor 53 appears in parallel with flame resistor 23. Therefore, resistor 53 may produce the same signal as shown by waveform 35 in FIG. 3. Waveform 35 shows the C-phase signal appearing at A/D input if flame resistance 23 or leakage resistance 53 exists. Waveform 35 may be of a circuit without the capacitor 28 in the interface circuit 31. The noted waveforms in FIG. 3 are example representations of the signals for illustrative purposes. These representations may vary in shape, magnitude and timing due to various circuit elements, component values, and signal and element parameters.

As the rod leakage resistance 53 may produce the same signal as flame resistance 23 can, one may need to take necessary precautions to limit the leakage path and check for leakage during operation. A printed circuit board (PCB) of the system may be laid out such that resistor 26 is well isolated from earth ground 11 connections. The flame rod and flame wire should likewise be well insulated. The leakage may and should be checked during each heating cycle involving a sensed flame. Before a flame is lit, the signal caused by leakage may be measured and the peak-to-peak value checked against a predetermined threshold. If the value is too high, then the flame sensing circuit may be unreliable because of high leakage. There may be a device with a warning indicating such. Otherwise, the peak-to-peak value of the leakage signal may be used as an offset value and be subtracted from the flame signal 35 when the flame is on as indicated by signal 33.

This approach may also be used to detect the presence of a short circuit between the flame rod 62 and the earth ground 11, such as an appliance ground, which may be a nuisance problem common during related appliance servicing. When the flame rod 62 is shorted to the appliance or earth ground 11, a very large C-phase component may be noticed at the A/D input 29. This peak value may be compared with a measured value for the C-phase and a determination may be made if the flame rod is shorted, or not, to the earth ground 11. If the flame rod 62 is determined to be shorted, then a control system may annunciate some kind of a problem alert to a service person.

Figure 4:
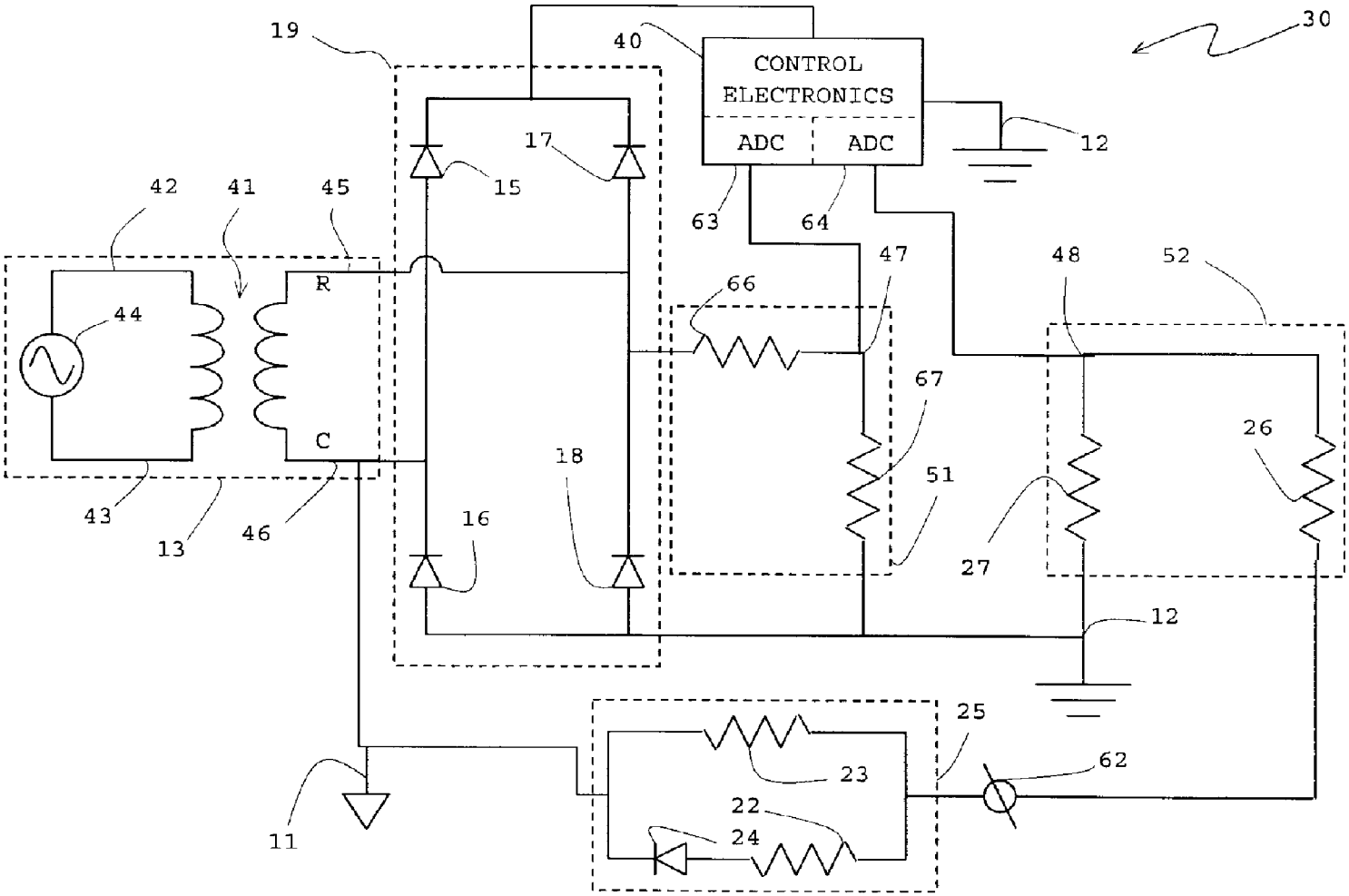
FIG. 4 is a diagnostic circuit for the flame sensing system.
Figure 5:
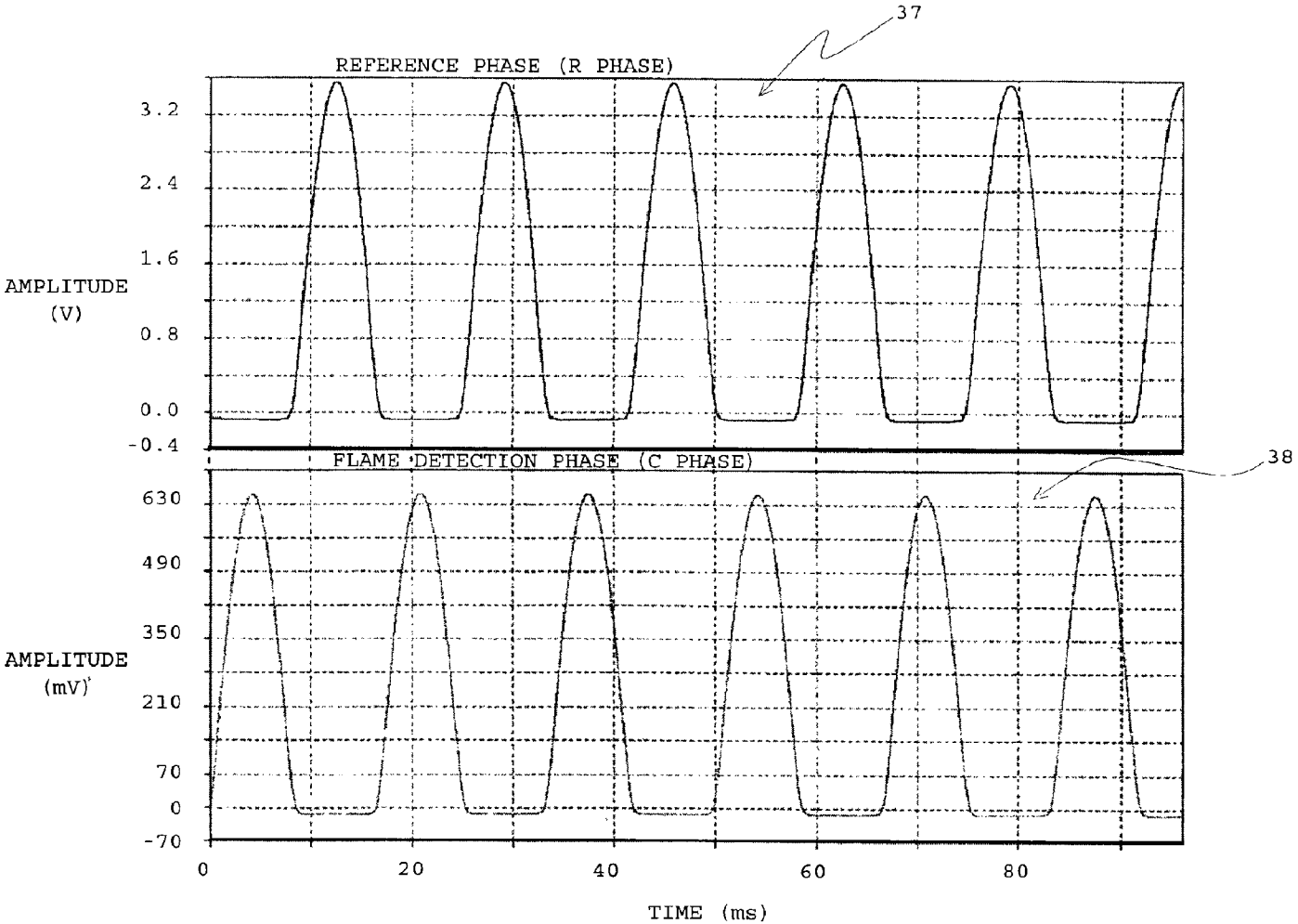
FIG. 5 is a graph of two out-of-phase signals from half-wave rectified power input signals.

This approach may also be used to detect which phase of a low voltage transformer of a source 13 is connected to earth ground 11. For example, if a circuit 30 of FIG. 4 is directly connected to one of the transformer 41 connections 45 or 46, it may compare the phase (R or C) of that connection with the signal measured by the flame sense input. If the flame sense signal is in phase with the reference transformer 41 connection, it may be assumed that the R-phase is connected to the earth ground 11. Otherwise, if the flame sensor signal may be more out of phase with the referenced transformer connection, it may be assumed that the C-phase of the transformer is grounded. As shown by the reference phase (R phase) waveform 37 and the flame detector phase (C phase) waveform 38 in FIG. 5, which are not in phase with each other, it may be determined that the reference phase is not connected to the earth ground 11.

Circuit 30 that may be utilized for determining which phase of a low voltage transformer 41 is earth grounded, as described above. Transformer 41 may have an AC input to leads 42 and 43 of its primary winding. The transformer 41 may provide isolation between the circuit 30 and an AC supply 44. The secondary winding may output a 24 volt AC signal at leads 45 and 46. The output of the transformer 41 may go to a full-wave bridge rectifier 19. Control electronics 40 may be connected across the rectifier 19. Control electronics 40 may include input analog-to-digital converter (ADC) 63 and ADC 64.

Lead 45 may be connected to an anode of diode 17 and a cathode of diode 18. Lead 46 may go to an anode of diode 15 and a cathode of diode 16. The cathodes of diodes 15 and 17 may be connected together. The anodes of diodes 16 and 18 may be connected to a circuit ground 12. Lead 46 of the secondary winding may be connected to an earth or appliance ground 11. A resistor 66 may have one end connected to lead 45, and have the other end connected to one end of a resistor 67. The other end of resistor 67 may be connected to circuit ground 12. The connection between resistors 66 and 67 may be a reference point 47. Resistors 66 and 67 may constitute a network 51. Point 47 may reveal a signal of ground 11 relative to ground 12 since the ADCs 63 and 64 may use a circuit ground 12 reference.

A resistor 27 may have one end connected to the circuit ground 12. The other end of resistor 27 may be connected to one end of a resistor 26. The other end of resistor 26 may be connected to flame rod 62 which in turn is connected to lead 46 of transformer 41 and ground 11 through flame resistor 23 when a flame exists. The connection between resistors 27 and 26 may be regarded as a flame sense point 48. Resistors 27 and 26 may constitute a network 52. A reference point 47 of network 51 may be connected to ADC 63 and flame sense point 48 of network 52 may be connected to ADC 64 of control electronics 40. The signal to ADC 63 may indicate a phase sensing and the signal to ADC 64 may indicate a flame sensing signal imposed on a phase signal relative to ground 12. The signals to ADC 63 and ADC 64 may be about 180 degrees out of phase relative to each other under normal circumstances.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A flame sensing system comprising:

a flame sensing rod;

a first impedance having a first terminal connected to the flame sensing rod and having a second terminal connected to a first reference point;

a rectification circuit having a first terminal connected to the first reference point and a second terminal connected to a second reference point, wherein the first reference point is different from the second reference point; and wherein, upon an existence of a flame at the flame sensing rod, a second impedance connected between the flame sensing rod and the second reference point appears.

2. The system of claim 1, wherein the rectification circuit comprises:

a first diode having an anode connected to the first terminal and having a cathode connected to the second terminal; and a second diode having an anode connected to the first terminal and having a cathode connected to a third terminal of the rectification circuit.

3. The system of claim 2, further comprising an AC voltage source having a first terminal connected to the second terminal of the rectification circuit and a second terminal connected to the third terminal of the rectification circuit.

4. The system of claim 3, wherein the first impedance comprises:

a first resistor connected to the first terminal of the first impedance and to a middle terminal of the first impedance; and a second resistor connected to the second terminal and the middle terminal of the first impedance.

5. The system of claim 4, wherein:

the first terminal of the AC voltage source is a C phase signal terminal; and the second terminal of the AC voltage source is an R phase signal terminal.

6. The system of claim 4, wherein a current flowing from the second reference point to the flame sensing rod may indicate existence of a flame.

7. The system of claim 5, wherein a current leakage from the flame sensing rod to the second reference point may be indicated by a component of a C phase signal at the middle terminal of the first impedance, in absence of a flame at the flame sensing rod.

8. The system of claim 5, wherein a short between the flame sensing rod and the second reference point may be indicated by a component of a C phase signal at the middle terminal of the first impedance, in absence of a flame at the flame sensing rod.

9. The system of claim 5, wherein a magnitude and/or phase of a signal on the middle terminal of the first impedance may be an indicator of a diagnostic condition.

10. A flame sensing system comprising:

a flame sensing rod having a first terminal and a second terminal;

an impedance having a first terminal connected to the first terminal of the flame sensing rod and to a first reference point; and a rectifier mechanism having a first input terminal connected to a second reference point, a second input terminal, and a first output terminal connected to the first reference point, the first reference point is different from the second reference point.

11. The system of claim 10, further comprising a flame model circuit that becomes connected between the second terminal of the flame sensing rod and the second reference point during a presence of a flame proximate to the flame sensing rod.

12. The system of claim 11, wherein the rectifier mechanism comprises:

a first diode connected between the first input terminal and the first output terminal; and a second diode connected between the second input terminal and the first output terminal.

13. The system of claim 12, wherein:

the second input terminal of the rectifier mechanism is connected to a first phase of a power supply; and the first input terminal of the rectifier mechanism is connected to a second phase of the power supply.

14. The system of claim 13, further comprising a DC current blocker having a first terminal connected to the first phase of the power supply and having a second terminal connected to the first terminal of the flame sensing rod.

15. The system of claim 14, further comprising an indicator connected between the first terminal of the flame sensing rod and the first reference point.

16. The system of claim 15, wherein the indicator may receive signals that indicate leakage current from the flame sensing rod.

17. The system of claim 15, wherein the indicator may receive signals that indicate a phase relationship of signals at the first terminal of the flame sensing rod relative to the first or second reference point.

18. The system of claim 15, where the indicator is a processor having an A/D input.

19. A flame sensing diagnostic system comprising:

a reference impedance network having a first terminal connected to a first reference point, having a middle terminal and a second terminal;

a sensor impedance network having a first terminal connected to the first reference point, and having a middle terminal and a second terminal;

a flame sensing rod having a first terminal connected to the second terminal of the sensor impedance network, and having a second terminal;

a rectifier mechanism having a first input terminal connected to a second reference point, a second input terminal connected to the second terminal of the reference impedance network, and having a first output connected to the first reference point; and a processor having a first input connected to the middle terminal of the reference impedance network and a second input connected to the middle terminal of the sensor impedance network.

20. The system of claim 19, wherein:

if the processor indicates about a 180 degree out-of-phase relationship between a signal on the middle terminal of the reference impedance network and a signal on the middle terminal of the sensor impedance network, then the relationship may be normal; and if the processor indicates other than about a 180 degree out-of-phase relationship between the signals on the middle terminals, then the relationship may be abnormal.

21. The system of claim 19, wherein the rectifier mechanism comprises:

a first diode having a current input terminal connected to the first output terminal and having a current output terminal connected to the first input terminal; and a second diode having a current input terminal connected to the first output terminal and having a current output terminal connected to the second input terminal.

22. The system of claim 21, further comprising a power supply for providing a first phase to the second input of the rectifier mechanism and a second phase to the first input of the rectifier mechanism.

23. The system of claim 22, further comprising:

a processor having a first input connected to the middle terminal of the reference impedance network and a second input connected to the middle terminal of the sensor impedance network; and wherein the processor has a ground terminal connected to the first reference point.

24. The system of claim 23, wherein the processor may detect a grounding of the first or second phase of the power supply.

25. The system of claim 24, wherein the power supply includes a transformer having a first output connected to the second input of the rectification mechanism and having a second output connected to the first input of the rectification mechanism.

* * * * *